US006141984A

United States Patent [19]

Perzon et al.

[11] Patent Number: 6,141,984

[45] Date of Patent: Nov. 7, 2000

[54] COVER FOR A FREEZER WITH A BUILT-IN CONDENSATION DRAIN

[75] Inventors: Björn Perzon, Robertsfors; Kenneth Lundgren, Umeå, both of Sweden

[73] Assignee: Lop Lundgren & Perzon AB, Umea, Sweden

[21] Appl. No.: 09/125,687

[22] PCT Filed: Feb. 11, 1997

[86] PCT No.: PCT/SE97/00206

§ 371 Date: Sep. 16, 1998

§ 102(e) Date: Sep. 16, 1998

[87] PCT Pub. No.: WO97/31231

PCT Pub. Date: Aug. 28, 1991

[30] Foreign Application Priority Data

Feb. 23, 1996 [SE] Sweden ..... 9600684

[51] Int. Cl.[7] ..... F25D 21/06

[52] U.S. Cl. ..... 62/275; 62/248; 220/826; 220/827; 220/840; 220/841; 220/842; 220/524; 220/523

[58] Field of Search ..... 220/826, 827, 220/840, 841, 842, 524, 523; 62/248, 275

[56] References Cited

U.S. PATENT DOCUMENTS

| | | | |
|---|---|---|---|
| 2,874,866 | 2/1959 | Rudy | 220/523 |
| 3,233,612 | 2/1966 | Logan | 220/523 |
| 3,449,925 | 6/1969 | Barroero | 62/275 |
| 3,877,600 | 4/1975 | Beil | 220/826 |
| 3,911,245 | 10/1975 | O'Shaughnessy | 219/218 |
| 3,923,196 | 12/1975 | Miller et al. | 220/335 |
| 4,127,765 | 11/1978 | Heaney | 219/218 |
| 4,154,356 | 5/1979 | Schieve | 220/18 |
| 4,206,615 | 6/1980 | Sobajima et al. | 62/275 |
| 5,452,820 | 9/1995 | Mislavsky | 220/827 |
| 5,778,689 | 7/1998 | Beatenbough | 62/150 |

FOREIGN PATENT DOCUMENTS

| | | |
|---|---|---|
| 0 432 872 | 6/1991 | European Pat. Off. . |
| 0 635 689 | 1/1995 | European Pat. Off. . |
| 808 845 | 7/1951 | Germany . |
| 628069 | 8/1949 | United Kingdom . |
| 2 165 034 | 4/1986 | United Kingdom . |

*Primary Examiner*—Henry Bennett
*Assistant Examiner*—Mark Shulman
*Attorney, Agent, or Firm*—Young & Thompson

[57] ABSTRACT

A cover for a freezing counter includes two reciprocably pivotable oblong profile elements, and a heat emitting element and a drain along one of the profile elements.

11 Claims, 1 Drawing Sheet

COVER FOR A FREEZER WITH A BUILT-IN CONDENSATION DRAIN

BACKGROUND OF THE INVENTION

The present invention relates to a device in a freezing counter comprising at least one cover to cover the whole opening of the freezing counter or parts of it, the cover being linkedly arranged between an open and a closed position.

Open freezing counters have been in use since a long time e.g. in daily shops. The reason for this is that the goods to be sold should be well exposed and easily accessible to the consumer. The increasing prices for energy and the increasing environmental consciousness, have, however, discovered the large waste of energy in this type of open counters.

For reducing the energy consumption attempts have been made with different kinds of covers arranged over the large openings of the counters, usually sliding or folding covers. To maintain the exposition of products these covers are made of a transparent material, usually plastics.

As is well known temperature differences inside and outside of the counter create an ice formation around the covers. The ice formation is especially a problem with folding covers. The water condensed on the upfolded cover has a tendency to leak downwards along the cover and freeze around the counter's flexible socket. The coldness of the counter and the repeated openings of the cover allow water to accumulate as ice impairing and in the worst case preventing any opening of the cover. This becomes especially difficult, if the covers flexible socket is elongated and tight, the surrounding air thus not being able to flow around the socket to prevent any freezing.

In known counters with foldable covers this problem has been solved by arranging the links and the covers pivoting axis at the side of the freezing counter, e.g. at the outside of the counter. By this arrangement the link will not be exposed to the low temperature in the freezing counter and thus there is no risk of freezing.

To solve the problem of icing in such a way is not acceptable. The shop area must be used in the most efficient way, the floor area being either free for customers or used for exposing goods. Therefore, the freezing counters are designed with the freezing aggregates placed under the actual goods exposing space, the customers thus having access to the frozen goods from all sides. This implies that the covers in use must have their links in the freezing counter opening and preferably along the middle of the freezing counter opening thus giving the customers access to the frozen goods from all sides. Thus, the link itself is exposed to the freezing temperature and icing problems will occur.

SUMMARY OF THE INVENTION

It is an object of the present invention to overcome the above mentioned problems.

The invention relates to a device for freezing counters comprising at least one cover to cover the whole opening of the freezing counter or parts of it, the cover being correctedly arranged between an open and a closed position, a heat emitting element being arranged close to the covers flexible socket. The invention is especially suited for shop counters and for similar applications with a risk of a freezing around the links.

The heat emitting element of the device might be an electric cable or a similar heat emitting element, e.g. a coil etc. Moreover, an air stream or a warm liquid passing e.g. a channel, a duct or similar might provide this heating emitting element.

The pivotable socket of the cover might comprise two oblong profile elements being mutually pivotable, the first profile element being arranged at the counter unit and the other profile element at the cover.

Furthermore, the profile element arranged at the unit might run along some part of the total unit length and several covers can be provided together closing the whole opening of the unit or parts of it, each cover possibly provided with a profile element pivotably connecting the cover to the units profile element.

The heat emitting element might preferably be placed at the part of the cover pivotable socket provided at the unit.

Furthermore, a spring element is provided in the device in connection with the pivotable socket, the spring element being capable to keep the cover on one hand in an open position and on the other hand in a closed position. This spring element is preferably provided by bending a prestressed spring plate arranged between the profile elements and cooperating with these in such a way that two definite bent-over positions are achieved, one for the open cover and one for the closed cover.

A drain can be provided along one of the profile elements to accumulate eventually existing hot well damp and water from the upwardly pivoted cover. The drain is preferably arranged outside of the pivotable cover socket pivoting axis, the drain being capable of accumulating water leaking in the upwardly pivoted position down along the outside of the cover.

The profile elements are formed or designed in exemplary embodiments so that they, in the closed cover position provide an essentially closed channel running in the pivotable links longitudinal direction and that the profile elements in the covers closed position by means of the mutual pivotation provide an opening of the channel close to the cover socket to accumulate water leaking along the cover. Said heat emitting element might also be arranged in said channel.

Further characteristics and advantages of the invention will be evident from the detailed description here below of a preferred embodiment of the invention, providing an example and thus not limiting the protective scope of the invention. For a clearer readability references are inserted in the text to the attached figures of the drawing, in which equivalent or similar parts have the same reference.

DESCRIPTION OF THE PREFERRED EMBODIMENTS

Figure 1:
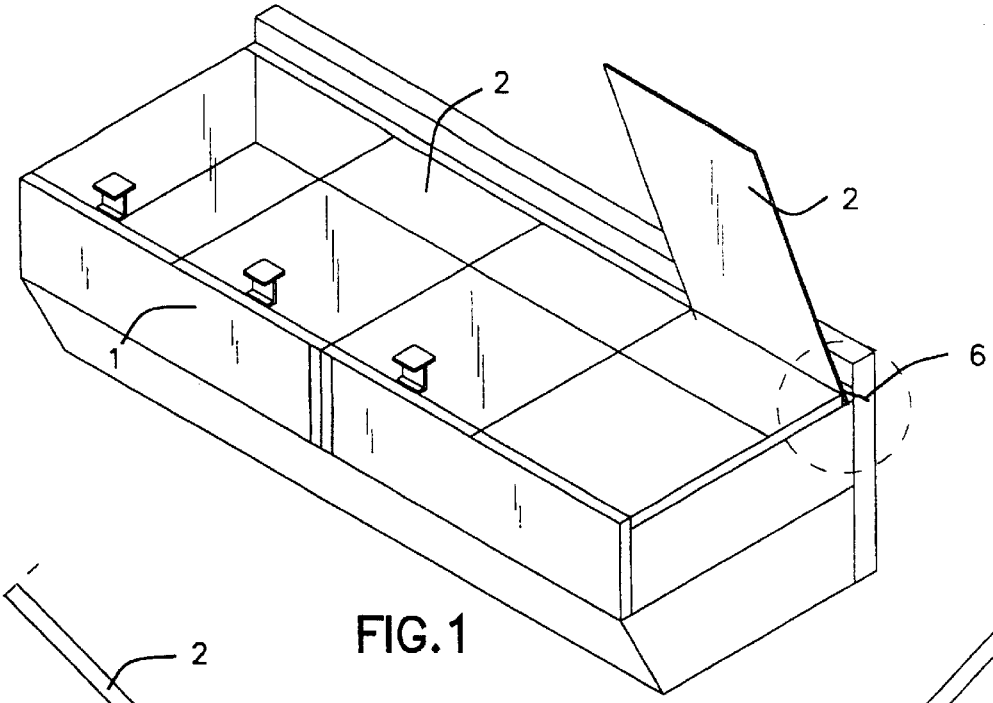
FIG. 1 shows schematically a freezing counter comprising a device according to one embodiment of the present invention.

In FIG. 1 a device is shown according to a first embodiment installed in a traditional upwardly open freezing counter 1. Several covers 2 are provided close to each other and together covering the whole opening of the counter. The covers are to be opened individually and are pivotably arranged along one side of each cover. The covers being made of a transparent material, such as plastics, the goods in the counter are exposed even with the covers closed.

Figure 2:
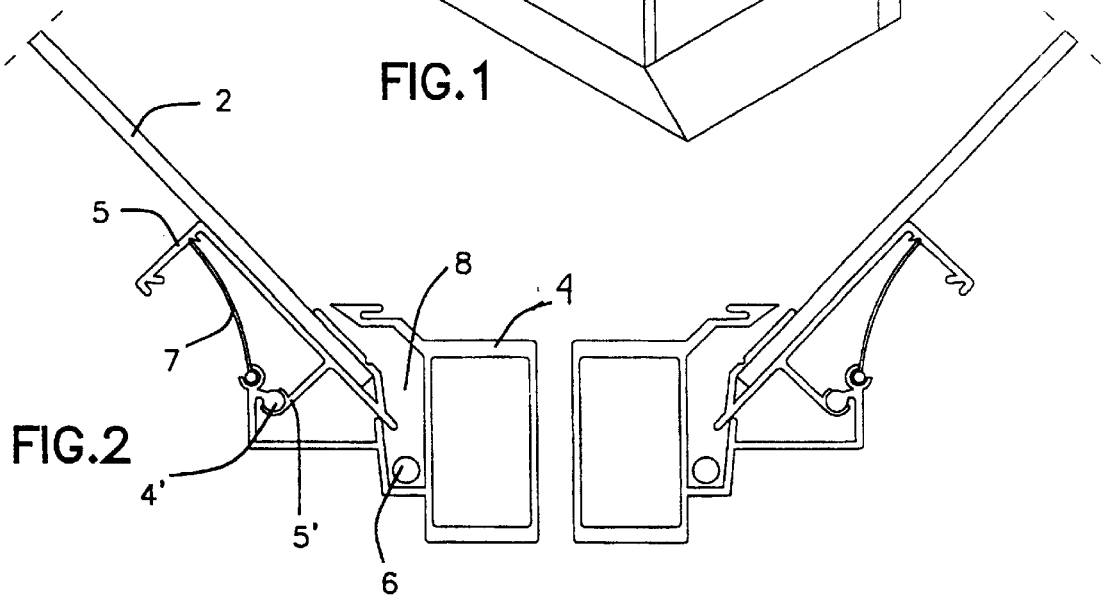
FIGS. 2 and 3 show an embodiment of a pivotable cover socket in the open and closed cover position, respectively.

In FIG. 2 the pivotable cover socket is shown in more detail. The socket is provided by means of two extruded aluminum parts 4 and 5, that are connected to provide an oblong link. The pivotable connection 4', 5' of the parts are provided in a way known in the art.

The two parts of the pivotable cover socket are situated one 5 at the cover and the other one 4 at the counter. With oblong profiles for the link, the link can advantageously be made tight in comparison with a cover provided with two distantly arranged links.

The link part 4 situated at the counter might advantageously run along the whole length of the counter and the part 5 arranged at the cover can preferably have a length essentially in accordance with the cover length along the freezing counter. Several covers 2 with a corresponding link part 5 might thus be arranged side by side at the same oblong counter link part 4. In an alternative embodiment both link parts 4 and 5 can have the same length and in a further embodiment the link might be split so that several interrupted links support one cover, i.e. links with a short length.

A heating element in form of an electric heating cable 6 is provided next to the link with the object to supply heat for preventing any icing in the link. In the present embodiment the heating cable 6 is placed along one of the link aluminium profiles, preferably along the link part 4 situated at the counter.

The heating element temperatures preferred for freezing counters are in the range between 40° C. and 80° C. and a cable temperature of 60° C. in especially preferred.

Moreover, the link parts 4, 5 are in the present embodiment provided in such a way that when water can leak downwards along the cover with the cover open, a drain is formed in the links longitudinal direction next to the at the open covers fixed end, the water leaking, downwards along the cover adapted to be accumulated in the drain. In this drain also the electric cable is situated, the heat from the cable preventing water to become ice and furthermore contributing to a successive evaporation of the water.

Figure 3:
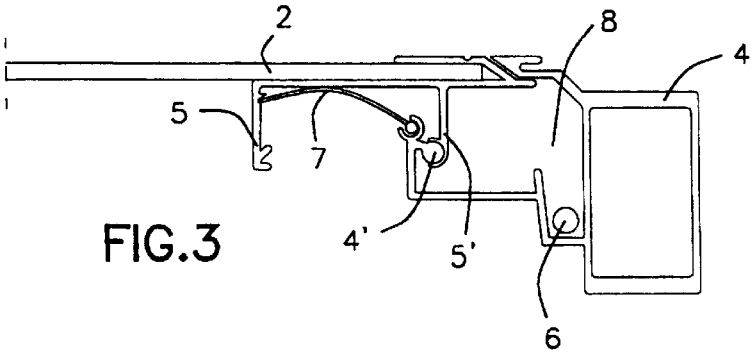

The link parts 4, 5 can preferably be designed in accordance with FIGS. 2 and 3, a further advantage being provided in that an open channel 8 (FIG. 2) is formed with the cover in an open position, the channel running along the link, i.e. a drain into which water and damp can accumulate, and in that said channel 8 in the closed position of the cover provides a channel with a generally closed circumference (FIG. 3). The heating cable 6 performing more efficiently in a closed space than with the cable lying completely open, this embodiment provides a possibility to reduce the energy consumption even for the heating element.

In an alternative embodiment these link parts or similar items with the same function might preferably be integrated in the counter itself, providing a more compact and discrete design.

Covers might of course be provided in such a way that a user can reach the contents of the counter from both its long sides, which is especially convenient for freezing counters situated between two parallel streams of customers, e.g. between two queues for the pay-desks. The pivotable socket of the covers might be arranged along the center of the counter opening, the covers running in a closed position from the center of the counter in two separate directions towards the counter long sides. Thus, two customers at each side of the counter can pivotably open their covers towards each other as schematically shown in FIG. 2.

In the last mentioned arrangement the two reversed parts 5 can preferably be arranged at a certain interspaced distance from each other. This distance provides a possible draining of the warm and damp air created in the freezing counter in connection with a deicing procedure. This is generally achieved automatically, not being totally efficient with the covers completely sealing the freezing counter.

Moreover, the use of aluminium parts 4, 5 implies that the link itself can have a supporting feature. The link according to the preferred embodiment shown above might e.g. be used without any further stabilizing additional features with a span of 4.5 meter between in sockets.

The invention has been described with a pivotable socket examplified by means of an oblong and tight one, but the scope of the invention protective area comprises also the provision of heating elements around further types of links and links with a similar object.

What is claimed is:

1. A top for a freezer counter, comprising:

plural covers, each of said covers for selectively closing a portion of an opening of a freezer counter;

a counter elongate part with a longitudinal pivoting axis;

plural cover parts that are each connected to a different one of said covers, each of said cover parts being pivotally connected side-by-side to said counter elongate part along the pivoting axis;

a heating element along a connection of said counter elongate part to said cover parts;

a drain arranged in said counter elongate part outside the pivoting axis to receive water from said plural covers when said plural covers are open; and a second said elongate counter part that is parallel and adjacent to said elongate counter part.

2. The top of claim 1, wherein said heating element is in said counter elongate part.

3. The top of said claim 1, wherein each of said cover parts comprises a spring adjacent the pivoting axis that selectively holds the respective one of said plural covers open and closed.

4. A top for a freezer counter, comprising:

plural covers, each of said covers for selectively closing a portion of an opening of a freezer counter;

a counter elongate part with a longitudinal pivoting axis;

plural cover parts that are each connected to a different one of said covers, each of said cover parts being pivotally connected side-by-side to said counter elongate part along the pivoting axis;

a heating element along a connection of said counter elongate part to said cover parts; and a drain arranged in said counter elongate part outside the pivoting axis to receive water from said plural covers when said plural covers are open, wherein said counter elongate part and each of said cover parts comprise opposing flaps that join when the respective one of said plural covers is closed to define a channel that is enclosed and extends longitudinally in said counter elongate part, said flaps not joining when the respective one of said plural covers is open so that said channel has an open longitudinal slot.

5. The top of claim 4, wherein said heating element is in said channel.

6. The top of claim 1, wherein said heating element is an electric heating cable.

7. A top for a freezer counter, comprising:

plural covers, each of said covers for selectively closing a portion of an opening of a freezer counter;

a counter elongate part with a longitudinal pivoting axis;

plural cover parts that are each connected to a different one of said covers, each of said cover parts being pivotally connected side-by-side to said counter elongate part along the pivoting axis;

a heating element along a connection of said counter elongate part to said cover parts; and said counter elongate part and each of said cover parts comprising opposing flaps that join when the respective one of said plural covers is closed to define a channel that is enclosed and extends longitudinally in said counter elongate part, said flaps not joining when the respective one of said plural covers is open so that said channel has an open longitudinal slot, said heating element being in said channel.

8. The top of claim 7, wherein each of said cover parts comprises a spring adjacent the pivoting axis that selectively holds the respective one of said plural covers open and closed.

9. The top of claim 7, further comprising in said channel.

10. The top of claim 7, wherein said heating element is an electric heating cable.

11. The top of claim 7, further comprising a second said elongate counter part that is parallel and adjacent to said elongate counter part.

* * * * *